US007661571B2

(12) United States Patent
Tsai

(10) Patent No.: US 7,661,571 B2
(45) Date of Patent: Feb. 16, 2010

(54) DESKTOP STAPLER

(75) Inventor: Eric Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 140 days.

(21) Appl. No.: 12/018,230

(22) Filed: Jan. 23, 2008

(65) Prior Publication Data

US 2009/0184150 A1 Jul. 23, 2009

(51) Int. Cl.
*B25C 5/11* (2006.01)
*B25C 5/02* (2006.01)

(52) U.S. Cl. ..... 227/134; 227/132; 227/107; 227/108

(58) Field of Classification Search ..... 227/134, 227/132, 19, 107, 108
See application file for complete search history.

(56) References Cited

U.S. PATENT DOCUMENTS

| | | | | |
|---|---|---|---|---|
| 4,109,844 | A * | 8/1978 | Becht | 227/120 |
| 4,272,002 | A * | 6/1981 | Moshofsky | 227/19 |
| 4,399,938 | A * | 8/1983 | Biddle | 227/132 |
| 4,582,237 | A * | 4/1986 | Storace et al. | 227/19 |
| 5,364,000 | A * | 11/1994 | Fealey | 227/124 |
| 5,765,742 | A * | 6/1998 | Marks | 227/132 |
| 2003/0115738 | A1 * | 6/2003 | Barlow et al. | 29/592 |
| 2003/0155400 | A1 * | 8/2003 | Jairam et al. | 227/134 |
| 2004/0084504 | A1 * | 5/2004 | Shor | 227/132 |
| 2005/0145667 | A1 * | 7/2005 | Susson | 227/120 |
| 2006/0163311 | A1 * | 7/2006 | Tsai | 227/155 |
| 2006/0231583 | A1 * | 10/2006 | Kumayama | 227/134 |
| 2007/0012745 | A1 * | 1/2007 | Jiang | 227/132 |
| 2007/0023473 | A1 * | 2/2007 | Jiang | 227/132 |
| 2007/0057012 | A1 * | 3/2007 | Kandasamy et al. | 227/134 |
| 2008/0223902 | A1 * | 9/2008 | Tsai et al. | 227/134 |

FOREIGN PATENT DOCUMENTS

| | | |
|---|---|---|
| TW | M 299629 | 10/2006 |
| TW | 200722244 | 6/2007 |

* cited by examiner

*Primary Examiner*—Brian D Nash
(74) *Attorney, Agent, or Firm*—Alan Kamrath; Kamrath & Associates PA

(57) ABSTRACT

A desktop stapler has a base member including a restricting unit; a magazine including a plunger disposed on the head thereof; two linkage devices; a press member; and a guide member. Each linkage device includes a first hole, a third hole, a second hole formed on a bend between the first and third holes, and a pivot hole. Each pivot hole connects with the base member via the restricting unit. The press member includes a press portion defined on the bottom of an end thereof, a grip portion defined on another end thereof and connecting to the plunger of the magazine, and two pivot holes formed on two sidewalls thereof and connected to the third holes of the linkage devices respectively via a coupler unit. The guide member includes a first end inserted via a coupler unit, a second end defining a press end, and two second pivot holes formed on two sidewalls thereof and opposite to each other.

14 Claims, 7 Drawing Sheets

DESKTOP STAPLER

BACKGROUND OF THE INVENTION

1. Field of the Invention

The present invention relates to a desktop stapler.

2. Description of the Related Art

A conventional stapler is shown in Taiwan Patent No. M299629. The stapler includes a linkage unit 40 having a first linkage 41 and a second linkage 42. The rear end of the first linkage 41 pivotally connects to the base 11. The head of the second linkage 42 is pivotally disposed to the press member 31, and the rear of the second linkage 42 pivotally connects to the first linkage 41. The advantage of the stapler in this reference is that the force of exerting to eject staples can be reduced via the specific arms of force due to the specific positions where the linkage unit 40 couples to parts of the stapler. Therefore, it can reduce the force for ejecting staples to 55%.

Furthermore, another conventional stapler for saving force to eject staples is shown in Taiwan Publication No. 200722244. The stapler includes a base 10, a magazine 20, a linkage 30, and a press member 40. The magazine 20 is adapted to receive staples and pivotally connects to the frame of the base 10. The linkage 30, which is mounted on the magazine 20 and pivotally connects to the frame of the base 10, includes two flanges 32 extending from two sides thereof and a plunger 33 disposed on the head thereof. The press member 40, which is mounted on the magazine 20 and pivotally connects to the frame of the base 10, includes two flanges 43 extending from two sides thereof and two slits 45 respectively formed on the flanges 43. Each slit 45 is adapted for receiving the related flange 32 slidably.

A user presses the press member 40, and the press member 40 pivots relative to the base 10. Hence, the flanges 43 drive the plunger 33 of the linkage 30 to eject staples from the magazine 20 via the transformation of the arms of force from the press member 40 to the linkage 30. Therefore, it can reduce the force of ejecting staples.

However, the frame is installed on the base 10 undetachably. The magazine 20 connects to the base 10 and is limited by the linkage 30 and press member 40 simultaneously. Therefore, when loading staples to the magazine 20, the magazine 20 is pulled outwardly from the rear end of the stapler. It is not convenient for users.

The present invention is therefore intended to obviate or at least alleviate the problems encountered in the prior art.

SUMMARY OF THE INVENTION

The present invention solves this need and other problems in the field of desktop staplers by providing, in a preferred form, a desktop stapler including a base member, a magazine pivotally connected with the base member and having a plunger disposed on an end thereof, two linkage devices, a press member and a guide member. Each linkage device forms a first hole, a second hole and a third hole. The press member pivotally connects to the third holes of the linkage devices via a coupler unit. The guide member includes a press end defined on an end thereof, another coupler unit disposed through another end thereof, and two second pivot holes formed between two ends thereof and spaced from each other. The second pivot holes of the guide member respectively pivotally connect to the second holes of the linkage devices via the two coupler units. The ratio of distance from the coupler unit disposed through the guide member to the third holes to distance from the third holes to the plunger of the magazine is about 3.3 to 1.5. The ratio of distance from the coupler unit disposed through the guide member to the second pivot holes to distance from the second pivot holes to the press end is about 1 to 4.

Other advantages, objectives and features of the present invention will become apparent from the following description referring to the attached drawings.

BRIEF DESCRIPTION OF THE DRAWINGS

The detailed description and technical characteristics of the present invention and described together with the drawings follows.

DETAILED DESCRIPTION OF THE PREFERRED EMBODIMENT

Figure 1:
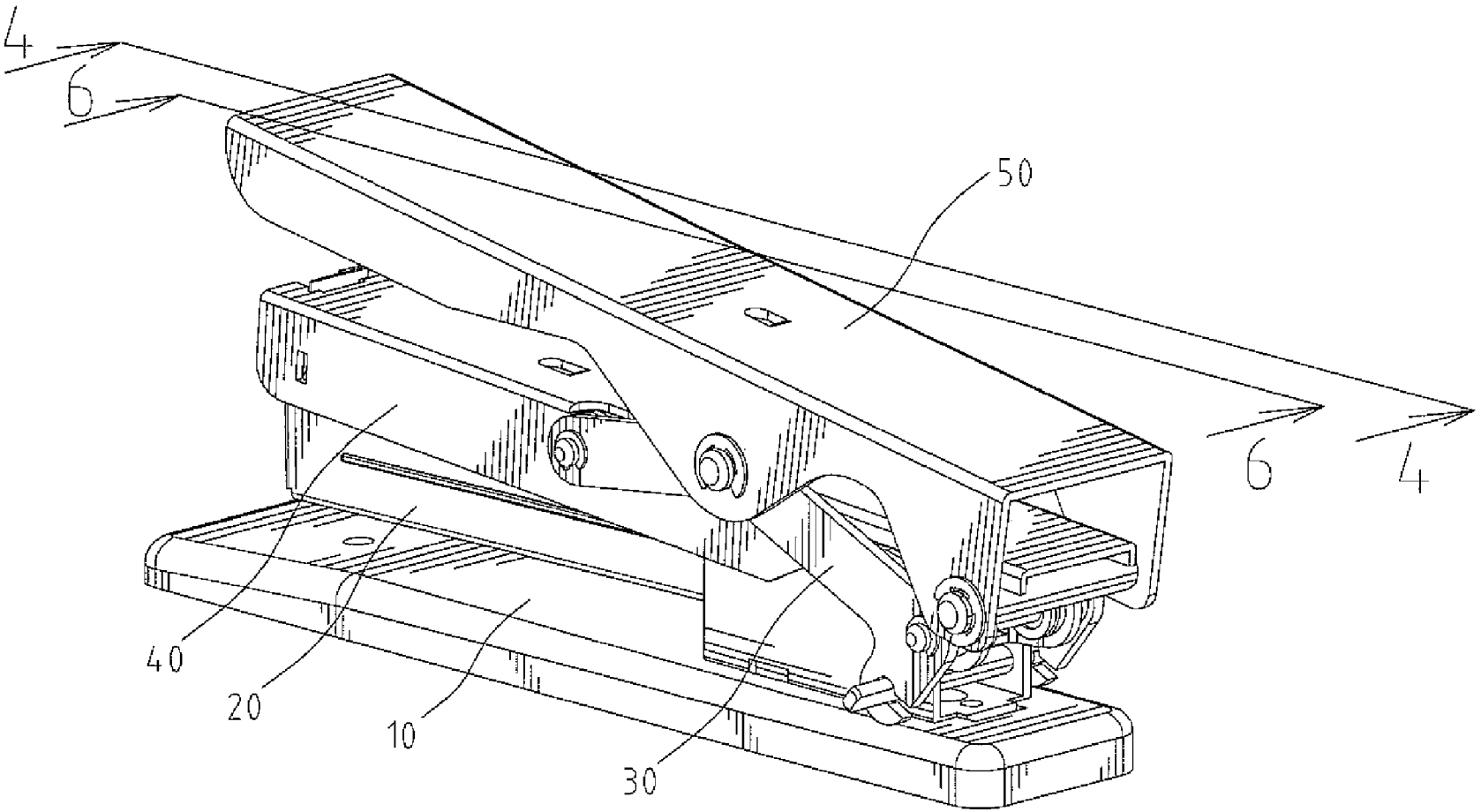
FIG. 1 is a perspective view of a desktop stapler in accordance with the first embodiment of the present invention.
Figure 2:
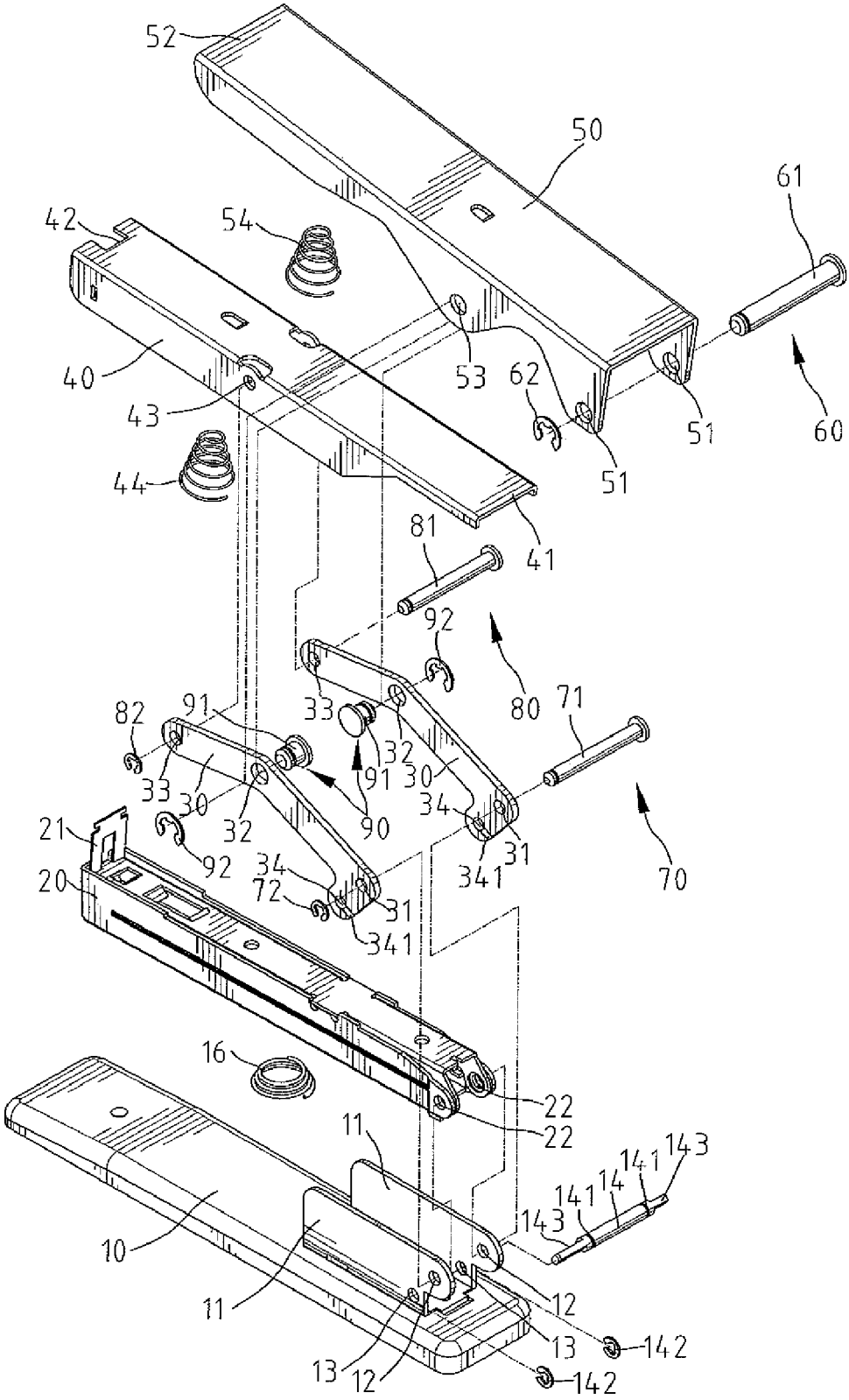
FIG. 2 is an exploded view of a desktop stapler in accordance with the first embodiment of the present invention.

Referring to FIGS. 1 and 2, a desktop stapler in accordance with a first embodiment in the present invention includes a base member 10, a magazine 20 pivotally installed to the base member 10, two linkage devices 30 located on the base member 10 and pivotally connected with the magazine 20 respectively, a press member 40 pivotally connected with the linkage devices 30, a guide member 50 mounted on the press member 40 and pivotally connected with the linkage devices 30, and a plurality of coupler units 60, 70, 80 90. The coupler units 60, 70, 80 90 respectively include shafts 61, 71, 81, 91 and C-shaped fasteners 62, 72, 82, 92. An end of each shaft 61, 71, 81, 91 forms a groove for receiving the fastener 62, 72, 82, 92.

The base member 10 includes two blade portions 11 disposed on the rear thereof, a pivot hole 12 and a fixed hole 13 respectively formed on the rear of each blade portion 11 and adjacent to each other, a restricting unit 14 inserted through the fixed holes 13 of the blade portions 11, and an elastic element 16 disposed between the blade portions 11 for pressing the magazine 20 upwardly and deadening the downward force of the magazine 20. Each pivot hole 12 and each fixed hole 13 are not located in the same horizontal or vertical position on the related one of the blade portions 11. The restricting unit 14 includes two annular grooves 141 formed on two ends thereof respectively, two clips 142 respectively received on the annular grooves 141 and disposed on two exterior sides of the blade portions 11, and two restricting portions 143 outwardly extending from each annular groove 141. Each clip 142 is C-shaped in a preferred form, and each restricting portion 143 is flat in a preferred form. The magazine 20 is adapted for receiving staples and includes a plunger 21 formed on the head thereof and two pivot holes 22 defined on the rear thereof and spaced from each other.

Each linkage device 30 includes a first hole 31 formed on an end thereof, a third hole 33 formed on another end thereof, a second hole 32 formed on a bend thereof between the first and third holes 31, 33, and a pivot hole 34 formed adjacent to the first hole 31. Each pivot hole 34 is not located between the first and second holes 31, 32. Comparing the horizontal positions of three holes 31, 32, 33, the second hole 32 is in the highest position. The ratio of distance from the first hole 31 to the second hole 32 to distance from the second hole 32 to the third hole 33 is about 0.9 to 0.6. Each linkage device 30 further includes a slit 341 which communicates with the pivot hole 34 and is open to the edge of each linkage device 30. Two ends of the restricting unit 14 are respectively adapted to insert through the pivot holes 34 and the fixed holes 13, and the restricting portions 143 respectively correspond to a shape of the slits 341 so that the restricting unit 14 can be pivoted to a specific position to detach from the slits 341. The first holes 31 respectively correspond to the pivot holes 12 of the base member 10 and the pivot holes 22 of the magazine 20. The coupler unit 70 inserts through the first holes 31, the pivot holes 22 of the magazine 20 and the pivot holes 12 of the base member 10 for connecting the linkage devices 30, the magazine 20 and the base member 10 to one another pivotally. The magazine 20 is located between the blade portions 11 of the base member 10 intermediately, and each blade portion 11 is located between one sidewall of the magazine 20 and one of the linkage devices 30.

The press member 40 includes a press portion 41 defined on the bottom of a first end thereof, a grip portion 42 formed on a second end thereof and adapted for connecting and driving the plunger 21 of the magazine 20, two pivot holes 43 formed on two sidewalls thereof respectively and being opposite to each other, and an elastic element 44 provided between the grip portion 42 and the pivot holes 43. The ratio of distance from the press portion 41 to the pivot holes 43 to distance from the pivot holes 43 to the grip portion 42 is about 1.6 to 1.3. The coupler unit 80 is inserted through the third holes 33 and the pivot holes 43 of the press member 40 for connecting the press member 40 to the linkage devices 30 pivotally. The press member 40 is located between the linkage devices 30 intermediately.

The guide member 50 includes two first pivot holes 51 defined on two sidewalls of a first end thereof and opposite to each other, a press end 52 defined on a second end thereof, two second pivot holes 53 formed on the two sidewalls thereof between the two first pivot holes 51 and the press end 52 respectively and opposite to each other, and an elastic element 54 provided to the bottom thereof between the second pivot holes 53 and the press end 52 for pressing the guide member 50 upwardly and deadening the downward force of the guide member 50. The ratio of distance from one of the first pivot holes 51 to the related second pivot hole 53 that is defined on the same sidewall as said first pivot hole 51 to distance from said second pivot hole 53 to the press end 52 is about 1 to 2.1. The coupler unit 60 is inserted through the first pivot holes 51 and fixed in the guide member 50 so that the press portion 41 of the press member 40 can be disposed on the shaft 61 of the coupler unit 60 and protrude from the guide member 50. The press portion 41 of the press member 40 is moveable between the interior wall of the guide member 50 and the shaft 61 of the coupler unit 60 freely.

The coupler units 90 pivotally connect the two linkage devices 30 with the guide member 50 respectively. The two second pivot holes 53 respectively correspond to and pivotally connect with the second holes 32 of the two linkage devices 30 via the coupler units 90.

Figure 3:
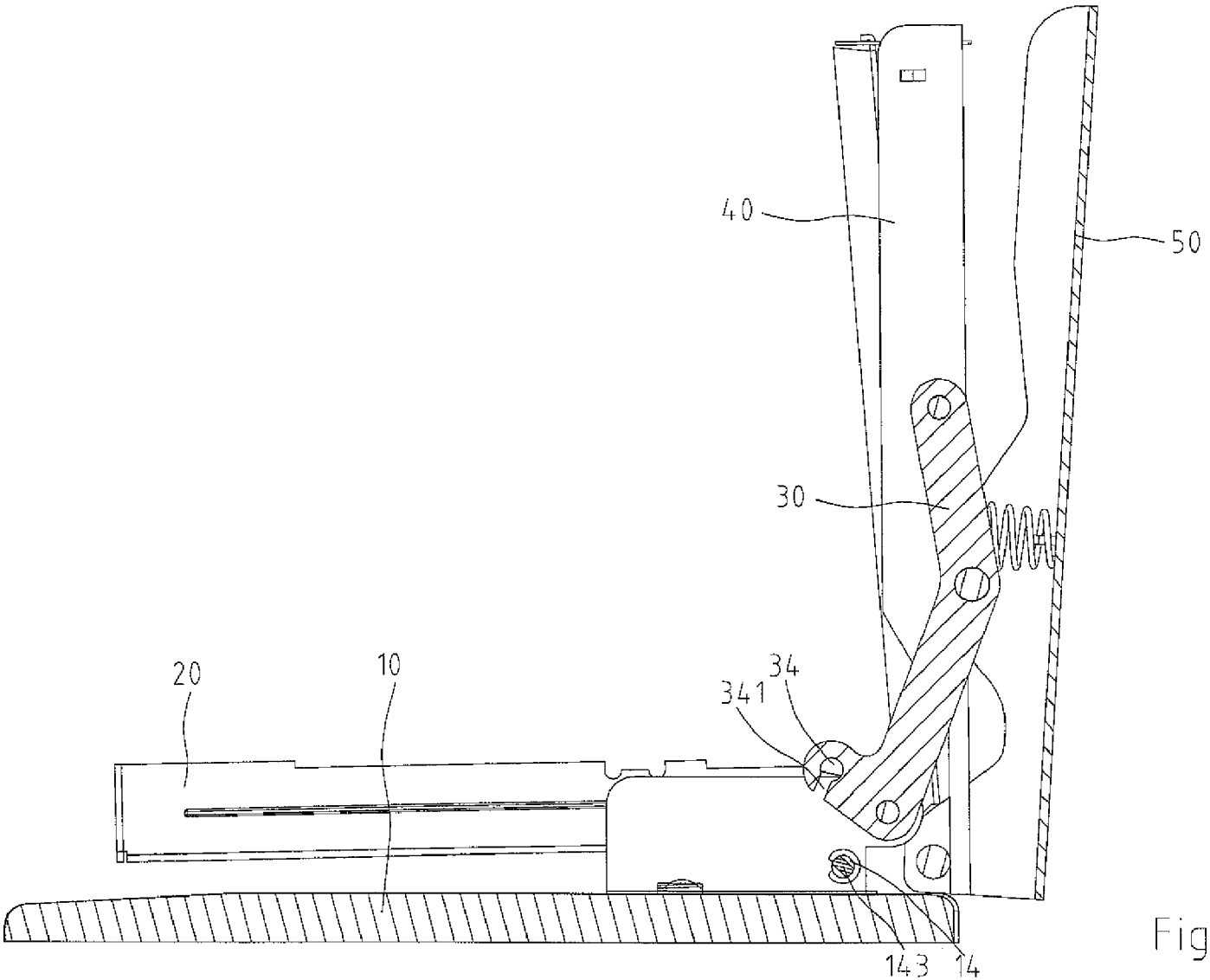
FIG. 3 is a sectional view of a desktop stapler in accordance with the first embodiment of the present invention.

FIG. 3 shows the magazine 20 being loaded with staples. Firstly, the restricting unit 14 is rotated until the restricting portions 143 respectively coincide with the slits 341 of the pivot holes 34 so that the restricting unit 14 can be rotated to the specific position for detaching from the pivot holes 34 through the slits 341. Secondly, the guide member 50, which pivotally connects with the press member 40, is opened by pivoting outwardly relative to the coupler unit 70 inserted through the first pivot holes 51 of the guide member 50 and the pivot holes 12 of the base member 10. Thus, staples can be loaded from the upside of the magazine 20. However, when loading of staples is finished, the guide member 50 is pressed to pivot downward for driving both the press member 40 and the linkage devices 30. The restricting portions 143 of the restricting unit 14 are respectively received in the pivot holes 34 of the linkage devices 30 through the slits 341. Next, the restricting unit 14 is rotated until the restricting portions 143 can not detach from the pivot holes 34 so that the linkage devices 30 are fixed not to pivot relative to the restricting unit 14.

Figure 4:
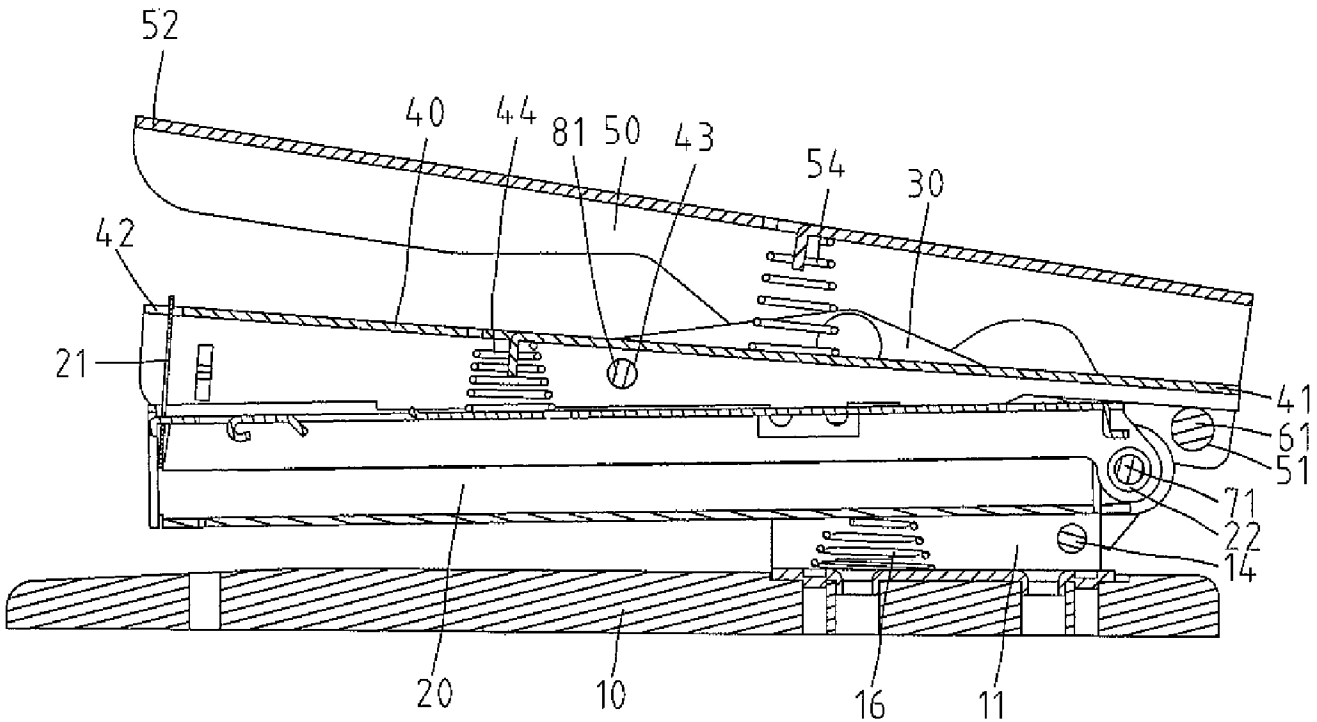
FIG. 4 is a sectional view taken along plane 4-4 in FIG. 1.
Figure 5:
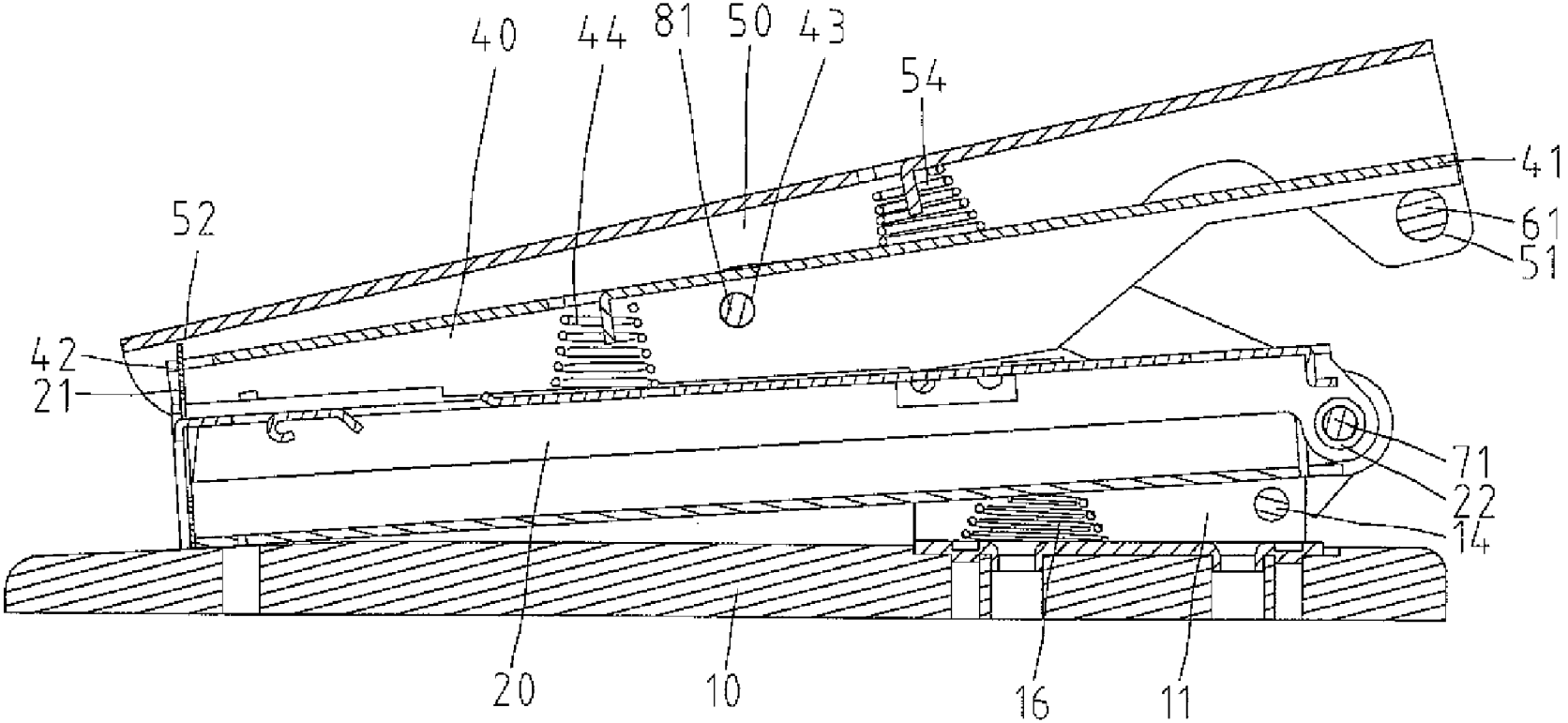
FIG. 5 is a sectional view similar to FIG. 4.
Figure 6:
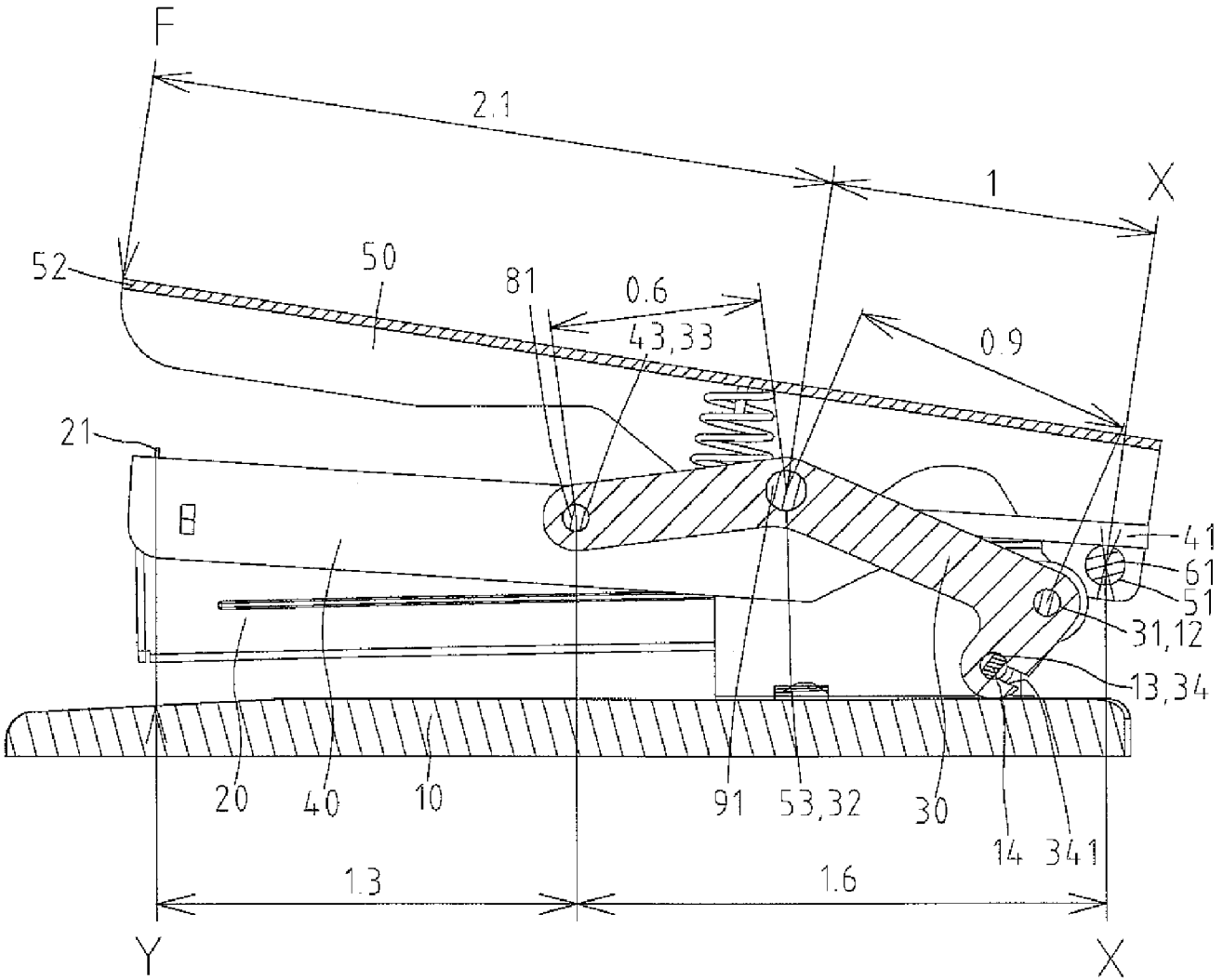
FIG. 6 is a sectional view taken along plane 6-6 in FIG. 1.

FIGS. 4 to 6 show when a user ejects staples, the press end 52 of the guide member 50 is pressed downwardly. The guide member 50 pivots on the coupler units 90 that respectively connect the second holes 32 to the second pivot holes 53. Hence, the first end of the guide member 50 is lifted relative to the second end of the guide member 50, and the press portion 41 of the press member 40 is driven to be lifted. The press member 40 is driven to pivot on the coupler unit 80 that is respectively inserted through the third holes 33 and the pivot holes 43 so that the grip portion 42 of the press member 40 is pressed downwardly to drive the plunger 21 of the magazine 20 for finishing to eject staples.

A user has to exert force F to press the press end 52 of the guide member 50 to pivot on the coupler units 90, which respectively connect the second pivot holes 53 to the second holes 32 and serve as a fulcrum. Next, a reaction force X to the force F is generated on the coupler unit 60, which is inserted through the first pivot holes 51. Subsequently, the press member 40 is driven to pivot on the coupler unit 80, which respectively connect the pivot holes 43 to the third holes 33, via the reaction force X. Next, a reaction force Y, that is a reaction force of the reaction force X, is generated on the grip portion 42. Furthermore, the reaction force Y is applied to react against the force F. While the user exerts the force F on the press end 52 to eject staples, he also has to react against the reaction force Y. By using a conventional stapler, the ratio of reaction force Y to force F is 1 to 1. Thus, the user has to exert force up to the force F, and the staple is ejected from the magazine 20. However, in the present invention, the reaction force Y is reduced with respect to the transformation of the force F to the reaction force X between the guide member 50 and the press member 40 which serves as levers. Thus, the user exerts force whose magnitude is the same as the reaction force Y, and the staple is ejected from the magazine 20. A reduced force U defined by subtracting the reaction force Y from the force F is what the user can exert for reacting against the reaction force from the plunger 21.

The relationship between the force F, X, Y and U is shown in an equation as follows:

$$2.1:1=F:X$$

$$X=0.476F$$

$$1.3:1.6=Y:X$$

$$Y=0.8125X=0.38675F$$

$$U=F-Y$$

$$U=F-0.38675F=0.61325F$$

Consequently, the stapler in accordance with the first embodiment in the present invention can reduce the user's force to 61.325%.

Figure 7:
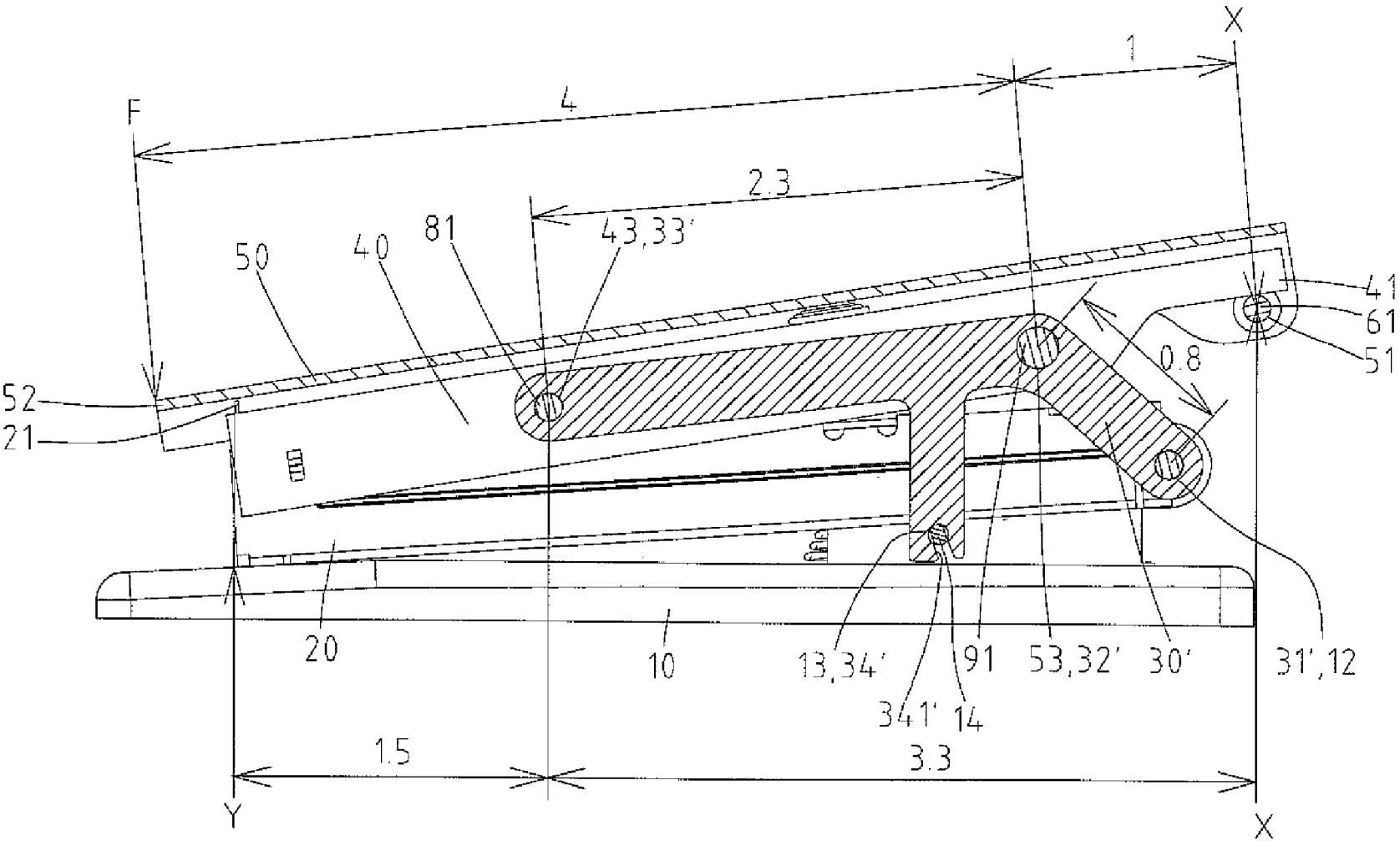
FIG. 7 is a sectional view of a desktop stapler in accordance with the second embodiment of the present invention.

Referring to FIG. 7, there is shown a stapler according to a second embodiment of the present invention. The second embodiment is like the first embodiment except several features.

Firstly, each linkage device 30 is replaced with a linkage device 30'. Each linkage device 30' includes a first hole 31' formed on an end thereof, a third hole 33' formed on another end thereof, and a second hole 32' formed on a bend thereof between the first and third holes 31', 33'. Each linkage device 30' further includes an arm downwardly extending from a side of the linkage device 30' adjacent to the second hole 32', and a pivot hole 34' defined on the distal end of the arm. Each pivot hole 34' is not located between the first and second holes 31', 32'. Comparing the horizontal positions of the three holes 31', 32', 33', the second hole 32' is in the highest position. The ratio of distance from the first hole 31' to the second hole 32' to distance from the second hole 32' to the third hole 33' is about 0.8 to 2.3. Each linkage device 30' further includes a slit 341' which communicates with the pivot hole 34' and is open to the edge of the arm of each linkage device 30'. Two ends of the restricting unit 14 are respectively inserted though the pivot holes 34' and the fixed holes 13, and the restricting portions 143 respectively correspond to the shape of the slits 341' so that the restricting unit 14 can be pivoted to a position to detach from the slits 341'.

Secondly, the ratio of distance from the press portion 41 to the pivot holes 43 to distance from the pivot holes 43 to the grip portion 42 is about 3.3 to 1.5.

Thirdly, the ratio of distance from one of the first pivot holes 51 to the related second pivot hole 53 that is defined on the same sidewall as said first pivot hole 51 to distance from said second pivot hole 53 to the press end 52 is about 1 to 4.

Therefore, in this embodiment, the relationship between the force F, X, Y and U is shown in an equation as follows:

$$4:1=F:X$$

$$X=0.25F$$

$$1.5:3.3=Y:X$$

$$Y\square 0.45455X\square 0.11364F$$

$$U=F-Y$$

$$U=F-0.11364F=0.88636F$$

Consequently, the stapler in accordance with the second embodiment in the present invention can reduce the user's force about to 88.636%.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A desktop stapler comprising:

a base member including a restricting unit;

a magazine including a plunger disposed on a head thereof;

two linkage devices, with each linkage device including a first hole formed on an end thereof, a third hole formed on another end thereof, a second hole formed on a bend between the first and third holes, and a pivot hole, with each pivot hole connected with the base member via the restricting unit;

a press member including a press portion defined on a bottom of an end thereof, a grip portion defined on another end thereof and connecting to the plunger of the magazine, and two pivot holes formed on two sidewalls thereof and connected to the third holes of the linkage devices respectively via a coupler unit;

a guide member including a first end inserted by a coupler unit, a second end defining a press end, and two second pivot holes formed on two sidewalls thereof and opposite to each other;

wherein the second pivot holes connect with the second holes of the linkage devices via the coupler units respectively for connecting the guide member with the linkage devices;

wherein the restricting unit can be rotated to a position to detach from the pivot holes of the linkage devices so that the linkage devices detach from the base member, and the guide member pivotally connected with the linkage devices can be lifted to open upwardly for loading the magazine with staples from an upside of the magazine.

2. The desktop stapler as claimed in claim 1, wherein the ratio of distance from the press portion to the pivot holes of the press member to distance from the pivot holes of the press member to the plunger of the magazine is about 3.3 to 1.5; wherein the ratio of distance from the coupler unit inserted through the first end of the guide member to the second pivot holes of the guide member to distance from the second pivot holes to the press end is about 1 to 4.

3. The desktop stapler as claimed in claim 2, wherein in each linkage device, the second hole is in the highest horizontal position than the first and third holes; wherein the ratio of distance from the first hole to the second hole to distance from the second hole to the third hole is about 0.9 to 0.6.

4. The desktop stapler as claimed in claim 3, wherein in each linkage device, the pivot hole is adjacent to the first hole.

5. The desktop stapler as claimed in claim 3, wherein each linkage device further comprises an arm extending therefrom downwardly, with the pivot hole formed on the arm.

6. The desktop stapler as claimed in claim 2, wherein in each linkage device, the second hole is in the highest horizontal position than the first and third holes; wherein the ratio of distance from the first hole to the second hole to distance from the second hole to the third hole is about 1 to 3.5.

7. The desktop stapler as claimed in claim 2, wherein each linkage device further comprises a slit formed from each pivot hole; wherein the restricting unit includes two restricting portions formed on two ends thereof; with the pivot holes corresponding to the restricting portions respectively.

8. The desktop stapler as claimed in claim 2, further comprising an elastic element disposed between the guide member and the press member.

9. The desktop stapler as claimed in claim 1, wherein the ratio of distance from the press portion to the pivot holes of the press member to distance from the pivot holes of the press member to the plunger of the magazine is about 1.6 to 1.3; wherein the ratio of distance from the coupler unit inserted through the first end of the guide member to the second pivot holes of the guide member to distance from the second pivot holes to the press end is about 1 to 2.1.

10. The desktop stapler as claimed in claim 9, wherein each linkage device further comprises a slit formed from each pivot hole; wherein the restricting unit includes two restricting portions formed on two ends thereof, with the pivot holes corresponding to the restricting portions respectively.

11. The desktop stapler as claimed in claim 9, further comprising an elastic element disposed between the guide member and the press member.

12. The desktop stapler as claimed in claim 1, wherein each linkage device further comprises a slit formed from each pivot hole; wherein the restricting unit includes two restricting portions formed on two ends thereof; with the pivot holes corresponding to the restricting portions respectively.

13. The desktop stapler as claimed in claim 1, further comprising an elastic element disposed between the guide member and the press member.

14. The desktop stapler as claimed in claim 1, further comprising two pivot holes formed on two sidewalls of the base member and connecting the base member with the magazine and the first holes of the linkage device via the coupler unit.

* * * * *